US006065469A

United States Patent [19]

Cleasby

[11] Patent Number: 6,065,469

[45] Date of Patent: May 23, 2000

[54] EMISSION CONTROL SYSTEM FOR ASPHALT KETTLE

[75] Inventor: Leslie J. M. Cleasby, Novato, Calif.

[73] Assignee: Cleasby Manufacturing Company, Inc., San Francisco, Calif.

[21] Appl. No.: 09/226,668

[22] Filed: Jan. 8, 1999

[51] Int. Cl.[7] ..... E01C 19/45; F24H 1/00

[52] U.S. Cl. ..... 126/343.5 A; 126/343.5 R; 432/72; 422/182; 110/212; 110/214

[58] Field of Search ..... 126/343.5 A, 343.5 R; 110/345, 344, 203–206, 210–212, 214; 432/72; 422/182, 183, 176, 198

[56] References Cited

U.S. PATENT DOCUMENTS

| | | | |
|---|---|---|---|
| 2,656,008 | 10/1953 | Engel | 183/6 |
| 3,754,869 | 8/1973 | Van Raden | 110/210 |
| 3,804,079 | 4/1974 | Schrader | 126/343.5 A |
| 3,880,143 | 4/1975 | Hart et al. | 126/343.5 A |
| 3,893,829 | 7/1975 | Valentino | 55/225 |
| 3,958,936 | 5/1976 | Knight, Jr. | 21/93 |
| 4,032,288 | 6/1977 | Numerowski | 432/189 |
| 4,032,361 | 6/1977 | Eriksson et al. | 110/212 |
| 4,033,328 | 7/1977 | Lohman et al. | 126/343.5 A |
| 4,153,471 | 5/1979 | Mendenhall | 106/281 R |
| 4,466,359 | 8/1984 | Weber et al. | 110/213 |
| 4,878,839 | 11/1989 | Wunning | 432/72 |
| 5,294,062 | 3/1994 | Hendrickson et al. | 241/67 |
| 5,520,342 | 5/1996 | Hendrickson et al. | 241/67 |
| 5,591,244 | 1/1997 | Vross et al. | 55/356 |

OTHER PUBLICATIONS

Product Brochure, "*We're Hot!*", Reeves Roofing EquipmentCo, Inc. Helotes, Texas.

Product Brochure, "*Get Cost Effective Long Lasting Built–Up Roofing Without Fumes & Orders*", National Tool & Equipment Co., Boardman, Ohio.

Product Brochure, "*FUMEGUARD*", Garlock Equipment Company, 1997, Minneapolis, Minnesota.

Excerpt from "*Methods for Control of Occupational Exposure to Asphalt Fumes During Hot Asphalt Roofing Work*": The National Institute for occupational Safety and Health; The United Union of Roofers, Waterproofers and Allied Workers; The Asphalt Roofing Manufacturers Association; the National Roofing Contractors Association; and the Asphalt Institute (Draft dated Dec. 18, 1996), pp. 32–36.

*Primary Examiner*—James C. Yeung

*Attorney, Agent, or Firm*—Limbach & Limbach L.L.P.

[57] ABSTRACT

An emission control system for an asphalt kettle combines a number of features to increase efficiency and convenience of operation, while minimizing potential safety hazards. The asphalt kettle is connected via a duct to a separate afterburner device equipped with a fan. This fan pulls fumes from a hood of the kettle through the duct to the afterburner device. The fan then pushes the fumes into a combustion chamber housed in the afterburner device. The combustion chamber includes an air port having an outlet proximate to the burner for furnishing a supply of fresh air to the flame to prevent its being extinguished by the rapid movement of gas through the combustion chamber. The afterburner device may include a one-way valve that prevents backdraft of ignited fumes from the combustion chamber into the kettle due to negative pressure within the kettle. The afterburner device may also include a temperature sensor that shuts down the fan in the event of kettle ignition.

16 Claims, 4 Drawing Sheets

EMISSION CONTROL SYSTEM FOR ASPHALT KETTLE

BACKGROUND OF THE INVENTION

1. Field of the Invention

The present invention relates to an emission control system for an asphalt kettle, and in particular, to an emission control system that includes a separate afterburner device housing a high powered fan which pushes fumes into a combustion chamber.

2. Description of the Related Art

Melting kettles for heating and melting bituminous materials of the asphaltic tar type are well known and have been used for many years in the roofing and roadway surfacing industries. Generally, these kettles are self-contained and transportable to the job site. As such, it is necessary that they do not require any undue servicing and that they be uncomplicated and reliable in operation.

The bituminous materials heated in these kettles inherently include compounds that vaporize and form objectionable fumes, smoke, and odors which have become an increasing nuisance in recent times. This problem is aggravated when the bituminous melt is heated to the higher temperatures commonly employed today, such that hydrocarbons of a higher order or length are vaporized.

Conventionally, fumes from the asphalt have been vented directly into the atmosphere without any smog or smoke control. Starting in the 1970's, there was a major effort to reduce kettle fume emissions in response to strict air pollution standards imposed by air quality management districts in the San Francisco Bay Area and in Southern California. A variety of technologies for controlling fume emissions were tested, and in some cases kettles equipped with these controls were manufactured and placed into service in the field. In general the experience to date with these kinds of controls has been decidedly unsatisfactory, particularly from a safety standpoint.

The kettle innovations tried in the past involved two types of controls: (1) emission capture and destruction devices, and (2) load insertion devices. Unfortunately, both approaches were abandoned after the researchers and engineers involved in this effort concluded that certain characteristics inherent in each of these types of controls substantially increased both the likelihood and the severity of kettle explosions and fires, and therefore presented serious worker safety hazards.

Emission capture and destruction controls consist of a vent or exhaust system that evacuates fumes from the head space inside the kettle to a capture or destruction device. Past experience with such systems suggests that it is difficult to evacuate fumes from the interior headspace of the kettle without creating an explosion and fire risk. This is because kettle fumes contain a variety of chemicals that are highly flammable, and thus the vapor inside the kettle is potentially explosive. As with any potentially explosive vapor, kettle fumes have an upper and lower explosive limit. At concentrations of fume below the lower explosive limit ("LEL"), the mixture is too "lean" to burn, while at concentrations above the upper explosive limit ("UEL"), the mixture is too "rich" to burn. During kettle operations, the concentration of fumes typically drops below the LEL almost instantly whenever the hood is opened and fumes are evacuated. When the kettle hood is closed, the fume concentrations build rapidly and the mixture almost immediately becomes too "rich" to pose an explosion hazard.

The treatment or destruction systems tested included afterburners, reburners, filters, and condensation systems. These types of emission control systems must draw fumes from the headspace inside the kettle, and thus reduce the concentration of asphalt fumes inside the headspace. In the absence of a control that regulates the air flow to maintain a specific fume concentration, emission control systems may bring the fume concentration back down into the explosive range. If fume concentrations in the headspace are within the explosive range, an explosion will be triggered by either a spark or by autoignition if the temperature rises to between approximately 500 and 575° F.

The kettle environment presents a variety of potential ignition sources, and previous attempts to suppress these ignition sources have generally been unsuccessful in controlling explosion hazards. For example, afterburner systems use an open flame that can act as an ignition source. The ignition risk associated with the afterburner can be reduced by the use of flame arresters, but previous experience indicates that flame arresters (at least those of past design) are prone to clogging and have not been sufficiently reliable to work effectively under actual operating conditions.

Another problem identified in connection with emission control is accumulation of coke or carbon deposits in the melting chamber of the kettle. When a kettle is operated at high temperatures, this buildup can become so hot that it will glow red, and act as an additional ignition source.

In systems that do not use afterburners or reburners, other potential ignition sources, such as the heating tube vent stack or flue, are present in virtually all kettles. Kettle heating tubes generally run lengthwise through the vessel, then turn and pass vertically through the kettle headspace to vent above the top deck of the kettle. Temperatures at hot spots on the heating tubes frequently exceed 500–575° F. on the surface of the vent stack, providing an ignition source.

Finally, in some situations the asphalt itself can become an ignition source. Some roofers overheat the asphalt for a variety of reasons even though this practice has long been strongly discouraged. If the asphalt reaches temperatures in the range of 500–575° F., the surface of the hot asphalt itself can become an ignition source and trigger a kettle explosion.

The second approach taken in reducing emissions relates to the manner by which loads are inserted into the kettle. Loading devices that permit refilling of the kettle without opening the lid substantially reduce fume emissions. A variety of designs have been tested and marketed, including "mail slot" openings, and loading "arms" that rotate and drop the solid asphalt into the melting chamber of the kettle. Since all of these devices must be located above the liquid level in the melting chamber, they increase the headspace above the liquid asphalt. This increased volume does not necessarily increase the risk of explosion, but can significantly increase the size of an explosion.

In addition, these loading devices can easily become clogged and difficult to use over time. This will effectively reduce the usable capacity of the kettle, creating an incentive to overheat the asphalt as described above.

U.S. Pat. No. 4,033,328, issued Jul. 5, 1977 and entitled "Tar Melting Kettle," discloses an asphalt kettle which includes a loading drum in the form of a rotating cylinder. Rotating the cylinder to align it with an opening in the melting chamber ensures that the contents of the kettle are not exposed to the atmosphere during loading.

This approach suffers from a number of problems. The user is denied visual access to the melting chamber to observe homogeneity of melting and the fluid level of the melted asphalt. This is dangerous insofar as the user may fail to detect that the fluid level has become dangerously low and cause a kettle fire.

In addition, the user is denied physical access to the melting chamber. This is dangerous insofar as coke and carbon residue is typically removed by skimming the top of the melt. Failure to adequately remove the coke and carbon in this manner can lead to the buildup of deposits and create an ignition source as described above.

California regulatory bodies driving the effort to develop emission control technologies ultimately determined that air pollution requirements would best be met through adoption of work practices which avoid overheating, and minimize the amount of time the kettle hood is left open. However, efforts to develop feasible, practical and safe emission controls for kettles have continued despite the unsatisfactory past experience with such systems.

U.S. Pat. No. 5,591,244, issued Jan. 7, 1997 and entitled "System for Removal of Noxious Fumes," discloses a fume control system for an asphalt kettle which passes fumes through a mobile filtration unit composed of a number of different filter elements. This approach suffers from a number of disadvantages. First, the system is relatively costly due to the need to include a plurality of specially manufactured filters. Second, the system is inconvenient to use due to the propensity of the filter units to become saturated with oils and solids associated with the fumes. Third, the system poses a possible safety hazard in that the oil-saturated filters can be ignited by the kettle.

Another recent design attempts to control kettle emissions by pulling fumes from the kettle through an combustion chamber housed in a stand-alone emission control unit. The FUMEGUARD™ asphalt fume elimination system, manufactured by Garlock Equipment Company of Minneapolis, Minn., includes a suction fan mounted downstream of the combustion chamber. This 150 cfm suction fan pulls the fumes into the combustion chamber. The FUMEGUARD™ includes a rotating loader mechanism similar to that described above in connection with U.S. Pat. No. 4,033,328.

The FUMEGUARD™ also includes an important safety feature. If the fan stops rotating, a negative pressure will arise within the kettle. This negative pressure can cause backdraft of ignited fumes from the combustion chamber into the melting chamber. To prevent ignition of the kettle under these conditions, the FUMEGUARD™ couples activation of the burner in the combustion chamber to rotation of the fan. Thus, in the event of a power failure or other problem affecting the fan the burner is automatically extinguished.

The FUMEGUARD™ design is viewed to have a number of disadvantages. First, the suction force provided by the 150 cfm can be inadequate to draw off kettle fumes when the hood of the device is raised to allow access to the melting chamber. In addition, positioning the suction fan downstream of the combustion chamber necessitates insertion of baffle structures between the burner flame and the suction fan, such that the baffle structures prevent the burner flame from being sucked into the fan. These baffles can interfere with thorough oxidation of the fumes by the afterburner, and increase the tendency of the flame in the afterburner to become extinguished. The baffles can also interfere with air flow through the afterburner chamber, limiting the effective suction force of the fan.

Moreover, these baffles can themselves provide an ignition source for fumes, effectively circumventing the safety precaution of linking the burner and fan. Specifically, if the fan fails and the burner is extinguished, the superheated baffles may still ignite fumes flowing back into the kettle.

Accordingly, there exists a need in the art for an emission control system for an asphalt kettle which overcomes the disadvantages present in the known art, and which provides safe and efficient removal of fumes even when the kettle lid is open to permit user access to the melting chamber.

SUMMARY OF THE INVENTION

The present invention relates to an emission control system for an asphalt kettle, and a method for controlling emissions from an asphalt kettle, which enables fumes to be drawn off and burned even when the hood of the kettle is open. This is accomplished by providing a high power fan in a separate afterburner unit.

A duct connects the afterburner unit to the kettle hood, such that the fan is directly downstream of the kettle. Fumes from the melting chamber are rapidly pulled by the fan from the kettle hood through the duct and into the afterburner device. These fumes are then pushed by the fan into a combustion chamber.

The kettle includes windshields projecting upward from the kettle on either side of the kettle hood. These windshields substantially enclose the melting chamber when the hood is in an open position, blocking cross-currents of outside air from blowing the fumes of the melting chamber into the environment.

The combustion chamber of the afterburner device includes an air port having an outlet proximate to the burner flame, such that a constant supply of outside air is supplied by convection to the burner. This ensures a strong and durable afterburner flame, even in the face of the rapid movement of gases provided by the fan.

The combustion chamber of the afterburner device may also include a one-way flapper valve that prevents backdraft of the burner flame into the kettle. In the event that negative pressure arises within the kettle, this one-way valve prevents partially ignited fumes from the combustion chamber from being sucked back into the kettle and starting a fire.

The afterburner device in accordance with the present invention may also include a temperature sensor positioned at the inlet of the afterburner device. Power is supplied to the fan via the temperature sensor. In the event that the sensor detects temperatures indicative of kettle ignition, it will interrupt power to the fan. Deactivating the fan in this manner halts the flow of fresh air into the kettle, snuffing out the kettle fire.

The features and advantages of the present invention will be better understood upon consideration of the following detailed description of the invention and the accompanying figures.

DETAILED DESCRIPTION

The present invention relates to an emission control system for an asphalt kettle, and also to a method of controlling emissions from an asphalt kettle. The present invention includes a number of features that increase efficiency and convenience of operation, while minimizing potential safety hazards.

Figure 1A:
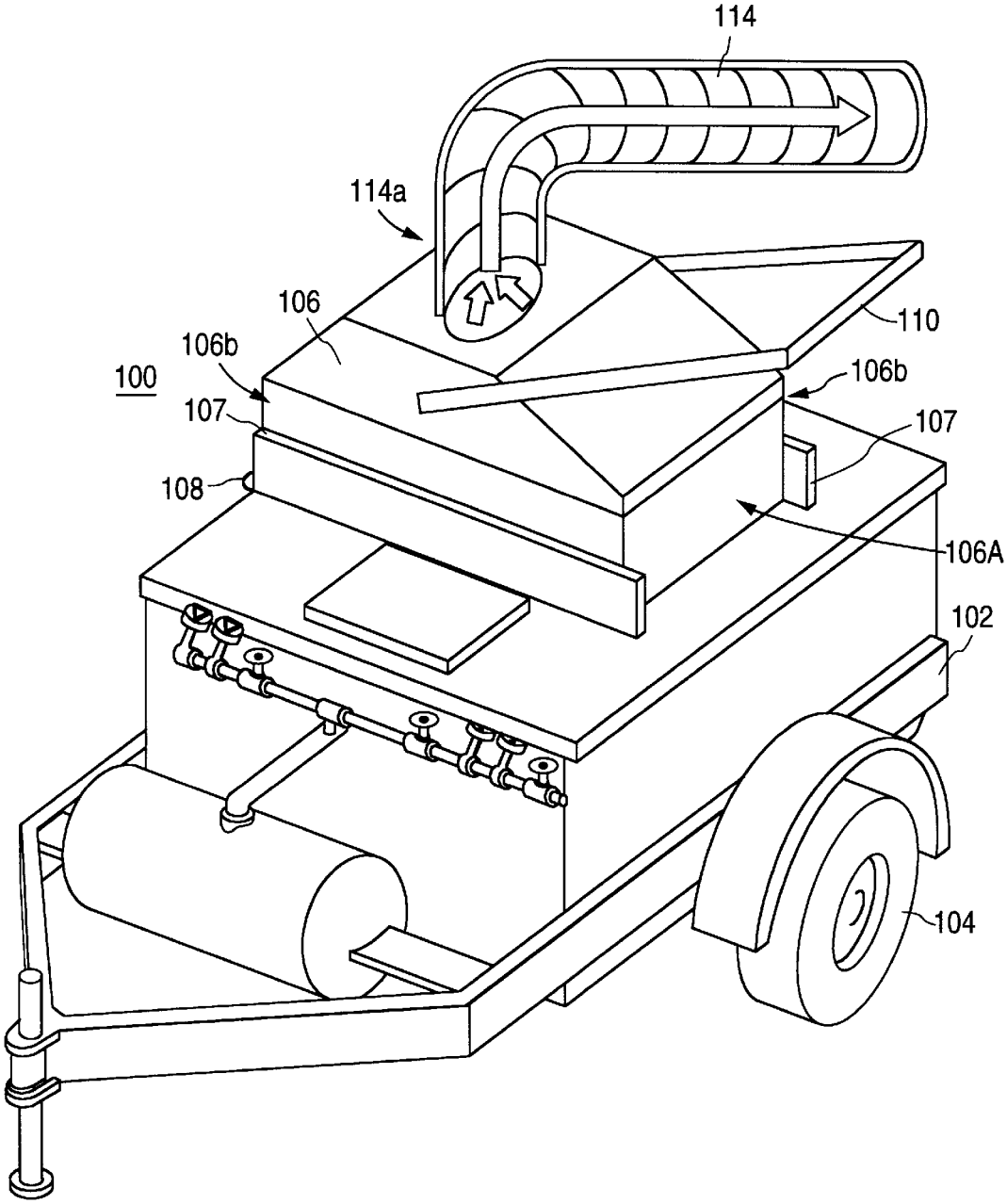
FIGS. 1A–1B show a partial cut-away view of an emission control system for an asphalt kettle in accordance with a preferred embodiment of the present invention.
Figure 1B:
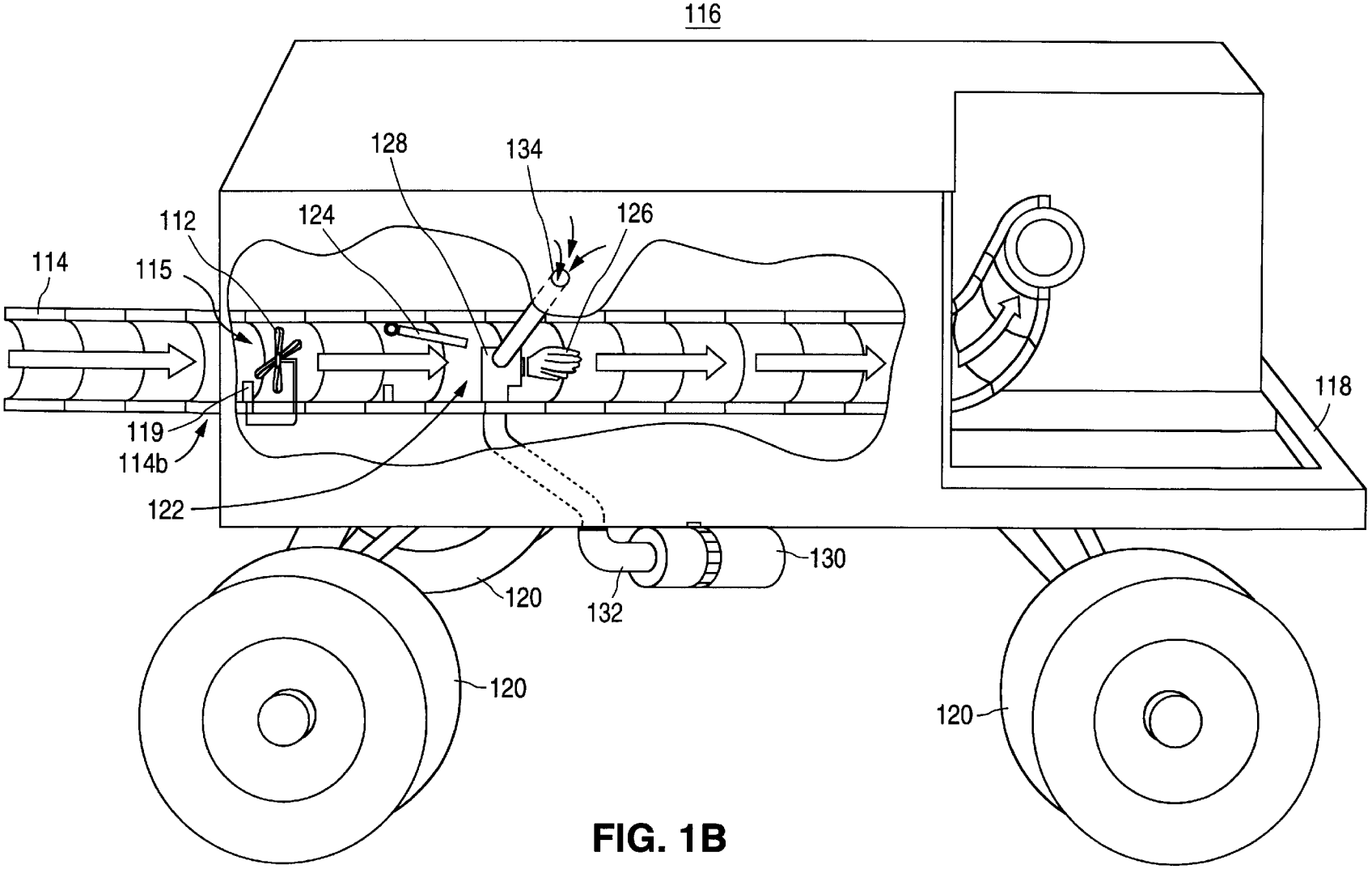

FIGS. 1A–1B show a partial cut-away view of an emission control system in accordance with a preferred embodiment of the present invention. FIG. 1A shows the asphalt kettle 100 itself, which includes a chassis 102 supporting a melting chamber. Melting chamber is hidden in FIG. 1A, because hood 106 of kettle 100 is shown in the closed position. Kettle 100 also includes wheels 104 to enhance its portability.

Hood 106 includes a front 106*a* and sides 106*b*. Windshields 107 project upward from the kettle parallel to sides 106*b* of hood 106. Hood 106 is rotatably coupled to chassis 102 by hinge 108. Hood 106 includes a handle 110 to allow a user to easily open and close hood 106 without coming too close to the melting chamber.

In this manner, hood 106 is moveable to an open condition not exceeding the height of windshields 107. When hood 106 is moved to the open position, the user may visually inspect the fluid level of the melting chamber, and may skim off any coke or carbon residue floating on top of the melt.

Hood 106 is connected to first end 114*a* of duct 114. As shown in FIG. 1B, second end 114*b* of duct 114 is connected to inlet 115 of separate afterburner device 116.

Afterburner device 116 includes chassis 118 supporting temperature sensor 119, fan 112, and combustion chamber 122. Afterburner device 116 also includes wheels 120 to enhance its portability.

Fan 112 is positioned within afterburner device 116 just inside of inlet 115. Fan 112 pulls fumes from the melting chamber of kettle 100 into hood 106, and then through duct 114 into afterburner device 116. Fan 112 then pushes the fumes through a one-way flapper valve 124 into combustion chamber 122. Valve 124 permits movement of gases in only one direction, through inlet 115 into combustion chamber 122.

Once inside combustion chamber 122, the fumes are exposed to flame 126 of burner 128. Burner 128 is supplied with fuel from fuel tank 130 through hose 132. Burner 128 is typically fed with propane, butane, or some other commonly utilized fuel.

Fan 112 is specifically designed to be powerful enough to push fumes from kettle 100 into combustion chamber 122 at relatively high velocities. In one specific embodiment of the present invention, the fan is a model HS3 high temperature blower manufactured by Tjernlund Products Inc. of Minneapolis, Minn. This particular fan provides a gas flow velocity through the combustion chamber of about 490 cfm.

Due to the high speed of fan 112, flame 126 of burner 128 may be particularly susceptible to extinction by oxygen-poor gases from the kettle that are moving rapidly through combustion chamber 122. Accordingly, the present invention includes an air port 134 feeding directly into burner 128. As fumes pass through combustion chamber 122 and are exposed to burner flame 126, outside air is sucked by convection through air port 134 to burner flame 126. The fresh air supplied to burner 128 through air port 134 contains oxygen that stabilizes burner flame 126, ensuring that it is not extinguished by rapid movement of gases through combustion chamber 122.

Exposing the fumes to flame 126 of burner 128 is sufficient to destroy any oxidizable content. The colorless and odorless exhaust of combustion chamber 122 is vented from afterburner device 116 into the atmosphere. In this manner, the combustion process yields an exhaust sufficiently clean to satisfy environmental concerns.

The primary safety hazard posed by the asphalt kettle is ignition of fumes present in the kettle, leading to catastrophic fire and explosion. Accordingly, the preferred embodiment of the asphalt kettle emission control system in accordance with the present invention also includes temperature sensor 119 positioned in the afterburner device 116 immediately upstream of the fan 112.

Power is supplied to fan 112 via temperature sensor 119. Upon detecting of gas temperatures in excess of about 370° F., temperature sensor 119 interrupts the flow of current to fan 112. Rapid shut-down of fan 112 in this manner halts the flow of fumes from the melting chamber of kettle 100 through duct 114 to the afterburner device 116. This stops the flow of fresh air into the kettle, quickly extinguishing the fire. Immediately halting the fan upon kettle ignition also excludes afterburner device 116 itself from being ignited by the kettle fire.

Figure 2:
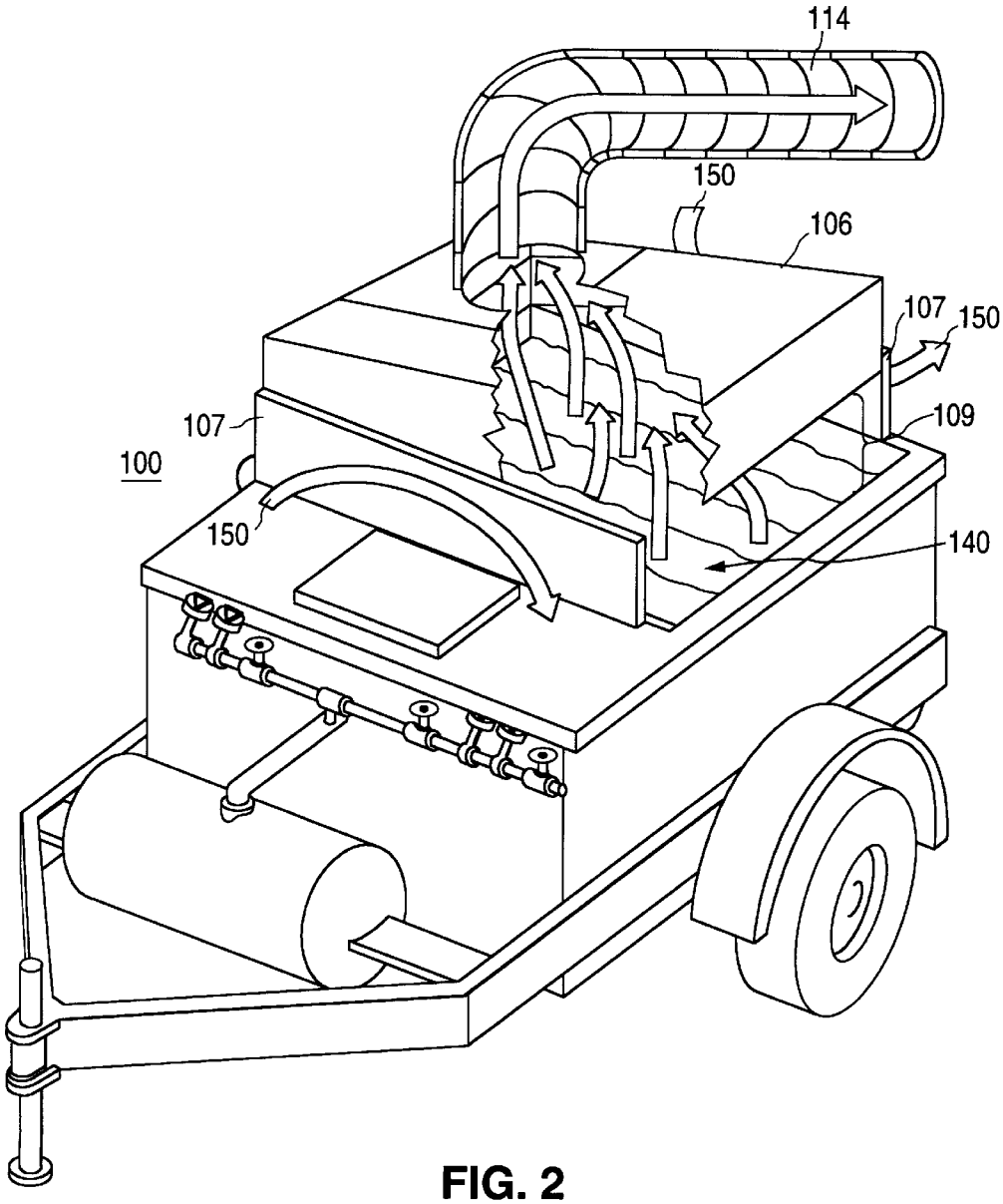
FIG. 2 shows a partial cut-away view illustrating operation of the emission control system for the asphalt kettle in accordance with the preferred embodiment, where the hood is in the open position.

FIG. 2 shows a partial cut-away view illustrating operation of the asphalt kettle in accordance with the preferred embodiment of the present invention, with hood 106 of kettle 100 in the open position. The handle of the hood is omitted in FIG. 2 for purposes of illustration,.

As shown in FIG. 2, hood 106 is moveable to an open condition such that hood opening 109 does not exceed the height of windshields 107. When hood 106 is in this open position, the user may visually inspect the fluid level of the melting chamber 140, and may skim off coke or carbon residue floating on top of the melt.

Even with hood 106 in the open position, fumes from melting chamber 140 are sucked into duct 114 and do not escape into the outside environment. This is because the suction force provided by fan 112 is sufficient to draw the fumes into hood 106.

Moreover, windshields 107 projecting upward from kettle 100 along sides 106*b* of hood 106 enhance the drawing power of fan 112 by substantially enclosing melting chamber 140 even when hood 106 is open. Windshields 107 also shelter melting chamber 140 from cross-currents 150 of outside air that could blow fumes from the kettle into the surrounding environment.

Figure 3:
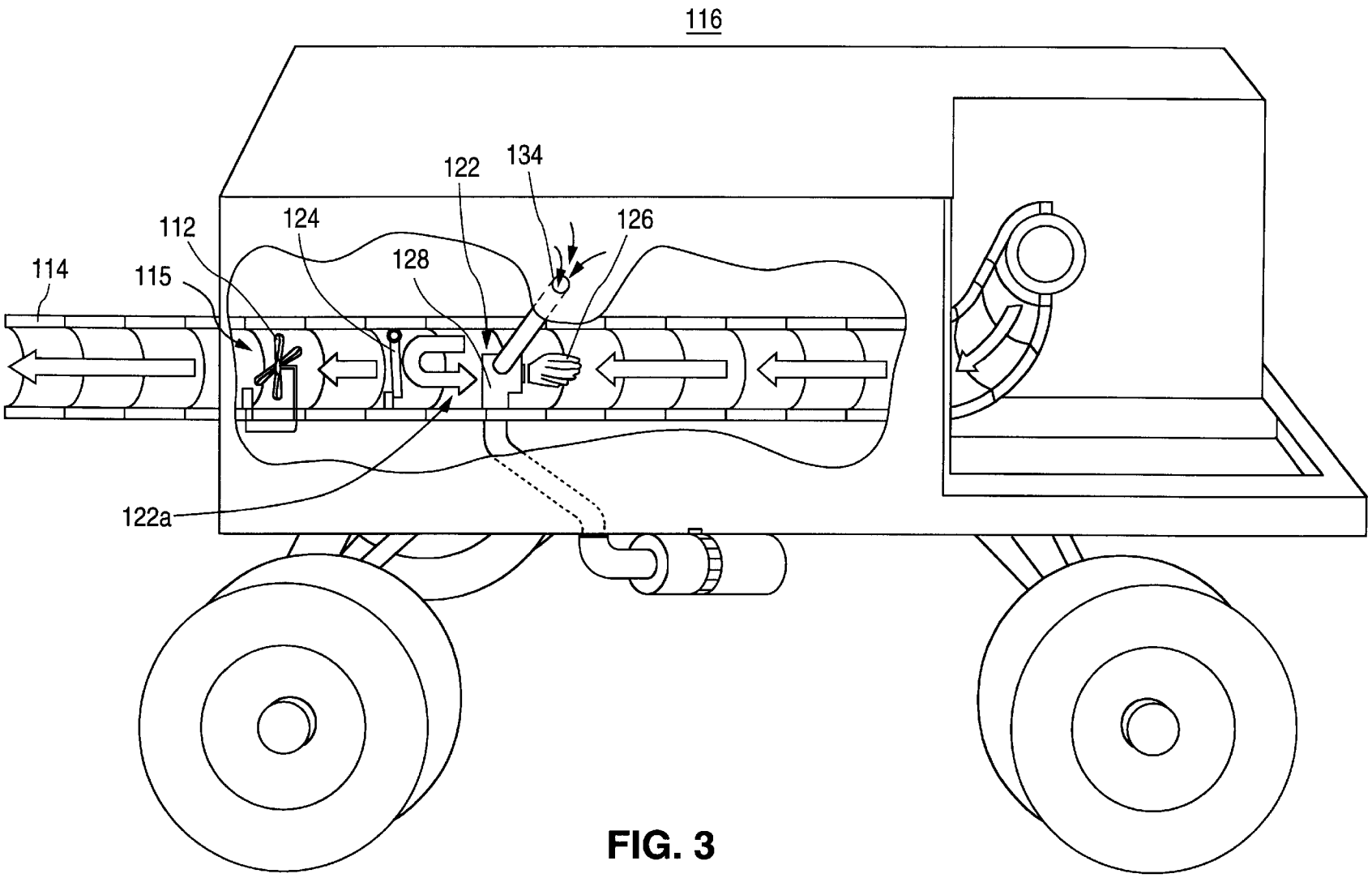
FIG. 3 shows a partial cut-away view illustrating operation of the afterburner device where negative pressure has arisen inside the kettle.

FIG. 3 shows a partial cut-away view illustrating operation of afterburner device 116 including combustion chamber 122, in the event that negative pressure arises within the kettle. Under these conditions, flapper valve 124 will rotate and block first end 122*a* of combustion chamber 122, preventing backdraft of ignited fumes from inlet 115 through duct 114 into the hood of the kettle. Loss of pressure within the kettle will therefore not result in flame 126 from burner 128 trailing back through the duct and igniting the kettle. In this manner, one-way flapper valve 124 provides an extra margin of safety in the event of an unanticipated or momentary loss of kettle pressure.

The emission control system in accordance with the present invention offers a number of important advantages over known devices.

First, the emission control system in accordance with the present invention offers more efficient and effective removal of fumes from the melting chamber to the combustion chamber. Because of the high power of the fan, and because this fan is positioned in the inlet of the afterburner device proximate to the source of the fumes, the drawing power of the fan is enhanced relative to devices having a fan positioned downstream of the combustion chamber.

As described at length above in connection with FIG. 3, a second important advantage offered by the present invention is elimination of possible backdraft of ignited fumes from the combustion chamber back into the kettle. In the event of even a momentary loss of fan speed giving rise to negative pressure inside the kettle, the flapper valve will close and block reverse movement of fumes. In this manner, fumes partially ignited by the burner in the combustion chamber cannot ignite fumes present inside the kettle.

A third important advantage offered by the present invention is that the burner flame cannot be inadvertently extinguished by rapid movement of gases through the combustion chamber. By providing an air port having an outlet located close to the burner flame, the burner is constantly supplied with a fresh supply of oxygen. This configuration promotes the strength and durability of the burner flame, despite the rapid gas flow provided by the fan.

Although the invention has been described in connection with one specific embodiment, it must be understood that the invention as claimed is not be unduly limited to this specific embodiment. Various other modifications and alterations in this invention will be apparent to those skilled in the art, without departing from the scope of the present invention.

For example, FIGS. 1A–3 describe the preferred embodiment of the present invention, which combines all of the advantageous features of the present invention. However, an asphalt kettle emission control system or a method for controlling asphalt kettle emissions in accordance with the present invention could exclude one or more of these features. Thus, an emission control system that does not include a fan controlled by a temperature sensor would fall within the purview of the present invention. The same is true for a method of controlling emissions that does not include a one-way flapper valve limiting backward movement of ignited gases from the combustion chamber into the kettle.

Therefore, it is intended that the following claims define the scope of the present invention, and that the methods and structures within the scope of these claims and their equivalents be covered hereby.

What is claimed is:

1. An emission control system for an asphalt kettle comprising:

a) a hood attached to the asphalt kettle, the hood including sides and a front, the hood covering a melting chamber housed within the asphalt kettle and moveable to a condition opening the kettle, the asphalt kettle comprising at least one windshield projecting upward from the kettle along a side of the hood to shield the kettle when the hood is moved to the condition opening the kettle;

b) a duct having a first end and a second end, the first end of the duct connected to the hood;

c) an afterburner device separate from the asphalt kettle, the afterburner device comprising:

1) an inlet connected to the second end of the duct;

2) a combustion chamber communicating with the inlet and housing a burner, the combustion chamber including an air port having an outlet end positioned proximate to the burner; and 3) a fan for drawing fumes from the duct into the combustion chamber, such that fumes emanating from the melting chamber are pulled by the fan through the duct into the inlet and then pushed by the fan into the combustion chamber.

2. The emission control system according to claim 1 wherein the windshield is disposed to at least one side of the kettle and so positioned that upon movement of the hood to a position opening the kettle the windshield fully shields said one side.

3. An emission control system for an asphalt kettle comprising:

a) a hood attached to the asphalt kettle, the hood covering a melting chamber housed within the asphalt kettle;

b) a duct having a first end and a second end, the first end of the duct connected to the hood; and c) an afterburner device separate from the asphalt kettle, the afterburner device comprising:

1) an inlet connected to the second end of the duct;

2) a combustion chamber communicating with the inlet and housing a burner, the combustion chamber including an air port having an outlet end positioned proximate to the burner, 3) a fan for drawing fumes from the duct into the combustion chamber, such that fumes emanating from the melting chamber are pulled by the fan through the duct into the inlet and then pushed by the fan into the combustion chamber, and 4) a temperature sensor positioned between the inlet and the fan, the temperature sensor communicating an electrical signal halting the fan when the temperature sensor detects a temperature greater than about 370° F.

4. The emission control system according to claim 3 wherein the fan is capable of moving fumes from the melting chamber to the combustion chamber at a velocity of about 490 cfm.

5. An emission control system for an asphalt kettle comprising:

a) a hood attached to the asphalt kettle, the hood covering a melting chamber housed within the asphalt kettle;

b) a duct having a first end and a second end, the first end of the duct connected to the hood; and c) an afterburner device separate from the asphalt kettle, the afterburner device comprising:

1) an inlet connected to the second end of the duct, 2) a combustion chamber communicating with the inlet and housing a burner, the combustion chamber including an air port having an outlet end positioned proximate to the burner, 3) a fan for drawing fumes from the duct into the combustion chamber, such that fumes emanating from the melting chamber are pulled by the fan through the duct into the inlet and then pushed by the fan into the combustion chamber, 4) a one-way valve positioned between the fan and the combustion chamber, such that the one-way valve prevents backward movement of fumes from the combustion chamber into the inlet, and 5) a temperature sensor positioned between the inlet and the fan, the temperature sensor communicating an electrical signal halting the fan when the temperature sensor detects a temperature greater than about 370° F.

6. The emission control system according to claim 5 wherein the fan is capable of moving fumes from the melting chamber to the combustion chamber at a velocity of about 490 cfm.

7. An afterburner device for eliminating emissions from an asphalt kettle, the afterburner device comprising:

1) an inlet receiving fumes from a melting chamber of the asphalt kettle;

2) a combustion chamber communicating with the inlet and housing a burner, the combustion chamber including an air port having an outlet end positioned proximate to the burner;

3) a fan for drawing fumes from the melting chamber into the combustion chamber, such that fumes emanating from the melting chamber are pulled by the fan into the inlet and then pushed by the fan into the combustion chamber; and 4) a temperature sensor communicating an electrical signal halting the fan when the temperature sensor detects a temperature greater than about 370° F.

8. The afterburner device according to claim 7 wherein the fan is capable of moving the fumes from the melting chamber to the combustion chamber at a velocity of about 490 cfm.

9. An afterburner device for eliminating emissions from an asphalt kettle, the afterburner device comprising:

1) an inlet receiving fumes from a melting chamber of the asphalt kettle;

2) a combustion chamber communicating with the inlet and housing a burner, the combustion chamber including an air port having an outlet end positioned proximate to the burner;

3) a fan for drawing fumes from the melting chamber into the combustion chamber, such that fumes emanating from the melting chamber are pulled by the fan into the inlet and then pushed by the fan into the combustion chamber;

4) a temperature sensor positioned between the inlet and the fan, the temperature sensor communicating an electrical signal halting the fan when the temperature sensor detects a temperature greater than about 370° F.; and 5) a one-way valve positioned between the fan and the combustion chamber, such that the one-way valve prevents backward movement of fumes from the combustion chamber into the inlet.

10. The afterburner device according to claim 9 wherein the fan is capable of moving the fumes from the melting chamber to the combustion chamber at a velocity of about 490 cfm.

11. A method for controlling emissions from an asphalt kettle comprising the steps of:

a) securing a hood having sides and a front to the asphalt kettle to capture fumes from a melting chamber housed within the asphalt kettle, such that at least one windshield projecting upward from the kettle along a side of the hood substantially encloses the melting chamber when the hood is in an open position;

b) providing a duct having a first end and a second end, the first end of the duct connected to the hood;

c) providing an afterburner device separate from the asphalt kettle, the afterburner device comprising:

1) an inlet connected to the second end of the duct, 2) a combustion chamber communicating with the inlet and housing a burner, the combustion chamber including an air port having an outlet end positioned proximate to the burner, and 3) a fan for drawing fumes from the duct into the combustion chamber;

d) activating the fan such that fumes emanating from the melting chamber are pulled by the fan through the duct into the inlet and then pushed by the fan into the combustion chamber; and e) oxidizing the fumes in the combustion chamber with a flame from the burner.

12. The method according to claim 11 wherein the step of securing a hood to the asphalt kettle further comprises securing the hood to the kettle such that upon movement of the hood to a position opening the kettle, the windshield fully shields said one side.

13. A method for controlling emissions from an asphalt kettle comprising the steps of:

a) securing a hood to the asphalt kettle to capture fumes from a melting chamber housed within the asphalt kettle;

b) providing a duct having a first end and a second end, the first end of the duct connected to the hood;

c) providing an afterburner device separate from the asphalt kettle, the afterburner device comprising:

1) an inlet connected to the second end of the duct, 2) a combustion chamber communicating with the inlet and housing a burner, the combustion chamber including an air port having an outlet end positioned proximate to the burner, 3) a fan for drawing fumes from the duct into the combustion chamber, and 4) a temperature sensor positioned between the inlet and the fan, such that the temperature sensor communicates an electrical signal halting the fan when the temperature sensor detects a temperature greater that about 370° F.;

d) activating the fan such that fumes emanating from the melting chamber are pulled by the fan through the duct into the inlet and then pushed by the fan into the combustion chamber; and e) oxidizing the fumes in the combustion chamber with a flame from the burner.

14. The method according to claim 13 wherein the step of providing a fan includes providing a fan capable of moving the fumes from the melting chamber to the combustion chamber at a velocity of about 490 cfm.

15. A method for controlling emissions from an asphalt kettle comprising the steps of:

a) securing a hood to the asphalt kettle to capture fumes from a melting chamber housed within the asphalt kettle;

b) providing a duct having a first end and a second end, the first end of the duct connected to the hood;

c) providing an afterburner device separate from the asphalt kettle, the afterburner device comprising:

1) an inlet connected to the second end of the duct, 2) a combustion chamber communicating with the inlet and housing a burner, the combustion chamber including an air port having an outlet end positioned proximate to the burner, 3) a fan for drawing fumes from the duct into the combustion chamber, 4) a one way valve positioned between the fan and the combustion chamber, such that the one-way valve prevents backward movement of fumes from the combustion chamber into the inlet, and 5) a temperature sensor positioned between the inlet and the fan, such that the temperature sensor communicates an electrical signal halting the fan when the temperature sensor detects a temperature greater that about 370° F.;

d) activating the fan such that fumes emanating from the melting chamber are pulled by the fan through the duct into the inlet and then pushed by the fan into the combustion chamber; and e) oxidizing the fumes in the combustion chamber with a flame from the burner.

16. The method according to claim 15 wherein the step of providing a fan includes providing a fan capable of moving the fumes from the melting chamber to the combustion chamber at a velocity of about 490 cfm.

* * * * *